United States Patent [19]

Gensberger

[11] Patent Number: 4,718,831

[45] Date of Patent: Jan. 12, 1988

[54] APPARATUS FOR COOLING A PRESSURE MEDIUM

[75] Inventor: Karl Gensberger, St. Ingbert, Fed. Rep. of Germany

[73] Assignee: Flutec Fluidtechnische Gerate GmbH, Sulzbach, Fed. Rep. of Germany

[21] Appl. No.: 850,661

[22] Filed: Apr. 11, 1986

[30] Foreign Application Priority Data

Apr. 13, 1985 [DE] Fed. Rep. of Germany ..... 3513324

[51] Int. Cl.[4] ..... F04B 17/00

[52] U.S. Cl. ..... 417/372

[58] Field of Search ..... 417/366, 367, 368, 372

[56] References Cited

U.S. PATENT DOCUMENTS

| | | | |
|---|---|---|---|
| 1,948,846 | 2/1934 | Des Roches | 417/372 |
| 1,979,851 | 11/1934 | Andresen | 417/372 |
| 2,018,521 | 10/1935 | Heitman | 417/372 |
| 2,040,507 | 5/1936 | Terry | 417/372 |
| 2,134,936 | 11/1938 | Getchell et al. | 417/372 |
| 2,152,056 | 3/1939 | Kenney et al. | 417/372 |
| 2,297,220 | 9/1942 | Hintze | 417/372 |
| 3,156,409 | 11/1964 | Paugh | 417/372 |
| 3,741,766 | 2/1974 | Kikutsugi et al. | 417/372 |

FOREIGN PATENT DOCUMENTS 82048266 8/1982 Fed. Rep. of Germany .

*Primary Examiner*—Croyle Carlton R.
*Assistant Examiner*—Timothy S. Thorpe
*Attorney, Agent, or Firm*—Roylance, Abrams, Berdo & Goodman

[57] ABSTRACT

An apparatus for cooling a pressure medium, especially hydraulic fluid, includes a motor-powered pump for conveying the pressure medium and a cooling device includes a fan for the conveying cooling air. In order to permit the cooling device to be mounted on the housing of the pump and/or its drive motor, preferably at the desired point above or below the combined pump and motor, the cooling device is located between columns on the housing of the motor-powered pump and/or on the housing of its drive motor.

5 Claims, 3 Drawing Figures

APPARATUS FOR COOLING A PRESSURE MEDIUM

FIELD OF THE INVENTION

The present invention relates to an apparatus for cooling a pressure medium, especially hydraulic fluid.

BACKGROUND OF THE INVENTION

A known device for conveying and cooling pressure medium is configured in a structural unit. A drive motor drives both the pressure medium pump and the fan wheel. The drive motor is suspended on holder elements located on supports inside the cooling device. The cooling device has a cooling coil with three coil layers surrounding the drive motor and a pressure medium pump. The coil layers are held apart from each other by spacer strips and distance strips distributed around the periphery. A housing for valves and switch devices extends axially along the cooling device. See for example, DE-GM No. 82 04 826.

SUMMARY OF THE INVENTION

An object of the present invention is to provide an apparatus for cooling pressure medium wherein the cooling device can be mounted above or below the housing of the pump and its motor, preferably the housing of the combined pump and drive motor unit, at any desired point.

Another object of the present invention is to provide an apparatus for cooling pressure medium which is simple and inexpensive to manufacture, and is of rigged construction.

The present invention originates from and is an improvement over the known device described hereinabove to provide the foregoing objects. More specifically, the foregoing objects are obtained by an apparatus for cooling pressure medium, especially hydraulic fluid, comprising a pump powered by a first motor for conveying pressure medium and supported by columns, a fan powered by a second motor separated from said first motor for conveying cooling air and a spiral cooling pipe mounted adjacent the fan. A crosspiece connects at least two of the columns. The fan housing is attached to the crosspiece such that the fan and the cooling pipe are located between the columns. A connection member, overlapping and outside of the fan housing, connects the pump and said cooling pipe in fluid communication.

The support columns serve to connect the cooling device (i.e., the fan and the cooling pipe) with the housing of the pump and/or the housing of the pump drive motor. The cooling device according to the present invention can be a separate unit or an integral part of the pump and/or the pump drive motor housing. The cooling device is advantageously accommodated in the space between the support columns. The columns and the cooling device can be arranged at any desired point on the housing of the pump and/or its drive motor. The columns, advantageously together with the cooling device, are to be mounted above or below the pump and/or the pump drive motor. If the columns are mounted below the pump and/or the pump drive motor, the columns serve as support legs for the pump and/or the pump drive motor.

The columns also serve for attachment of a connection member which can be coupled to the fan housing. The connection member bridges the pressure medium inlet or outlet to or from the pressure medium pump with the pressure medium inlet or outlet of the cooling device. The connection member has an additional connection, so that its connections to a hydraulic apparatus are arranged in a manner corresponding to the pressure medium connections of the pressure medium pump. Instead of only two columns being connected, all columns could be connected with each other by means of an annular arrangement of crosspieces.

A perferated covering can be provided for the protection of the cooling device.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF PREFERRED EMBODIMENTS

Figure 1:
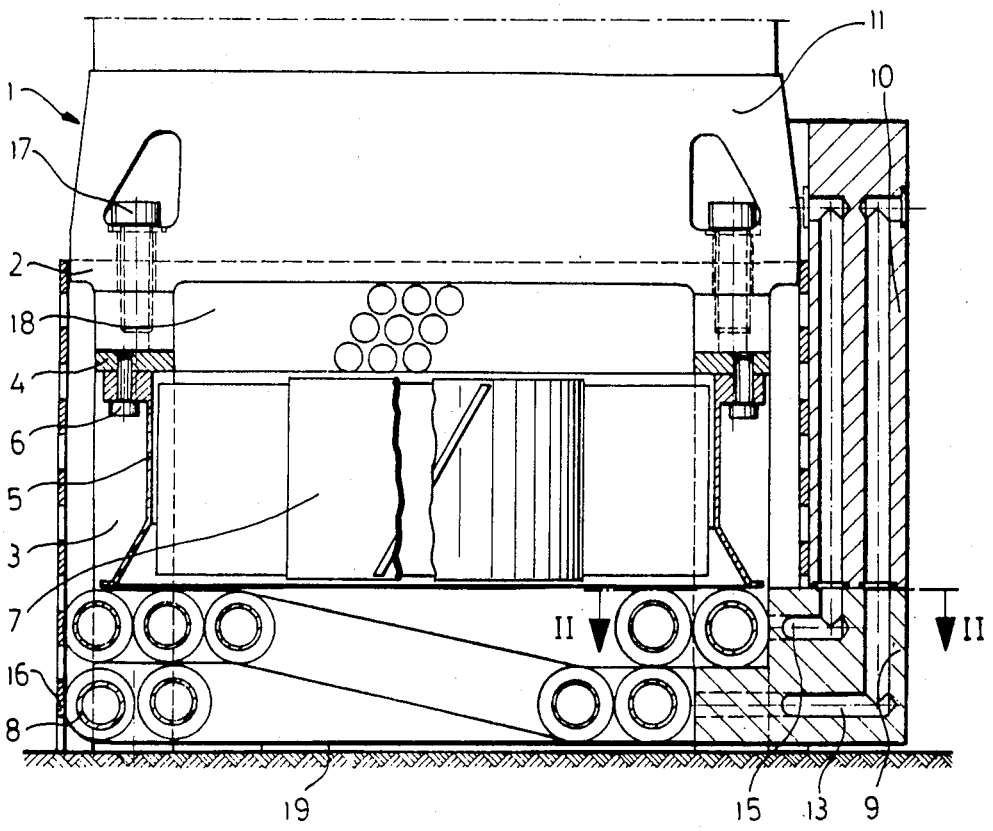
FIG. 1 is a side elevational view in partial section of an apparatus for cooling a pressure medium according to a first embodiment of the present invention.

A motor-pump assembly 1, for instance as disclosed in DE-OS No. 33 12 828, is arranged with a housing 11 having its four housing legs 2 on four support columns or legs 3. Support columns 3, are connected, at least in pairs, by a perpendicular crosspiece 4 to motor-pump assembly or housing 1, or by crosspieces with each other. A fan housing 5 is attached by means of screws 6 to both crosspieces 4. A fan wheel 7 is mounted in fan housing 5. In the hub of the fan housing, a fan drive motor is arranged. Housing crosspieces are provided for the bearing of fan wheel 7, and are arranged on fan housing 5. Fan 5, 7 is of customary commercial construction.

Beneath fan wheel 7, a helical or spiral cooling pipe 8 is located. The cooling pipe has cooling vanes arranged on its outside periphery. There is no tight or fixed connection between fan housing 5 and cooling pipe 8. Cooling pipe 8 is mechanically connected only with motor-pump housing 1, by means of a two-part connection member 9 and 10.

Figure 2:
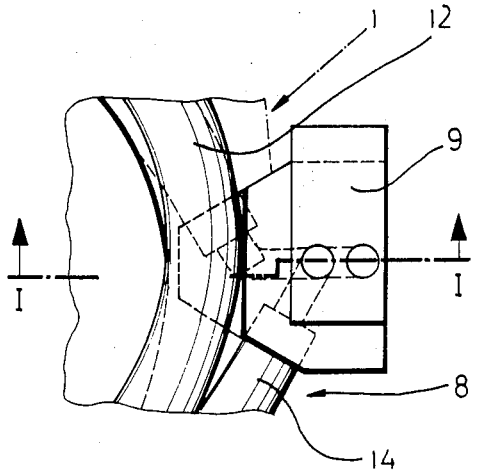
FIG. 2 is a partial top view of the apparatus taken along line II—II of FIG. 1.
Figure 3:
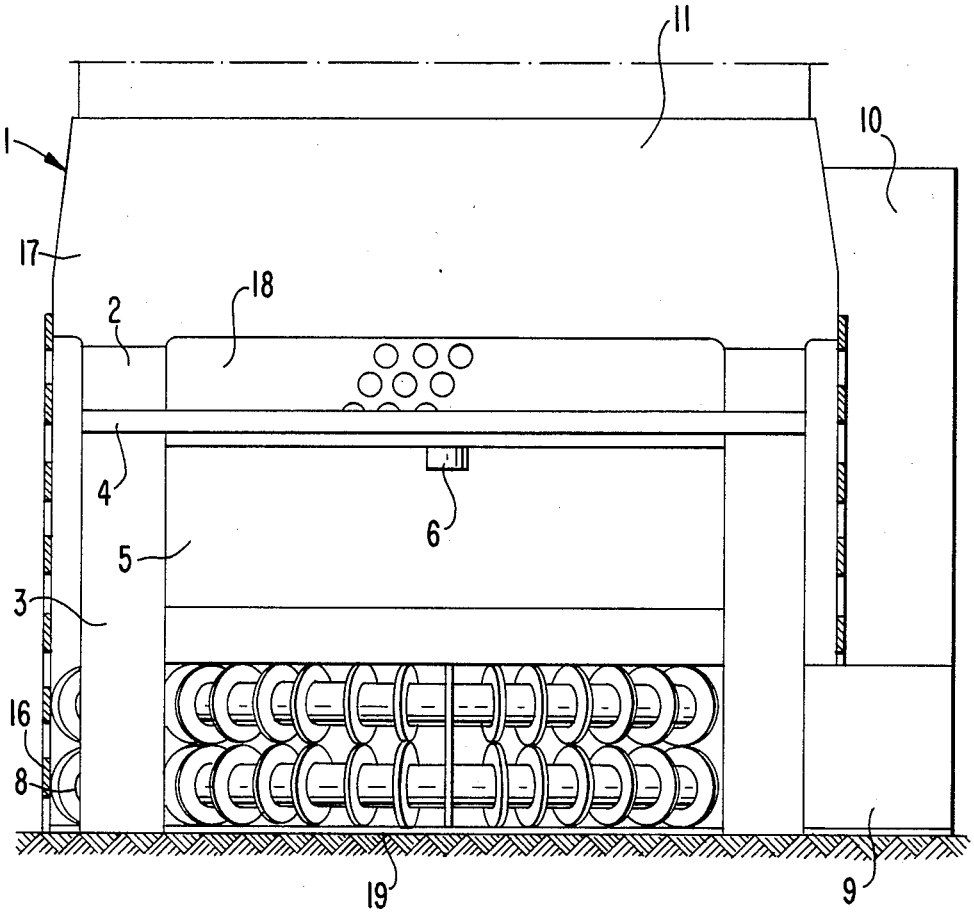
FIG. 3 is a side elevational view in partial section of the apparatus of FIG. 1, with only the covering sectioned and removed.

As shown in FIG. 2, there is also a connection of the internal conduits in cooling pipe 8 and connection member 9. According to the direction of the flow, the bottom cooling pipe end 12 is connected with a first connection passage 13 in connection member 9. The cooling pipe end 14 at the top is connected with a second connection passage 15 in connection member 9. The connection passages 13 and 15 extend horizontally, and then vertically in connection member 9, 10, in the vicinity of cooling pipe 8. The clearances present within connection member 9 and 10 are packed by sealing rings. First connection passage 13 leads to an outside connection, while second connection passage 15 is connected with the pump inlet or outlet.

The cooling device is surrounded only to the bottom of the motor-pump assembly 1 by a covering 16 with perforations. Covering 16 is connected with connection member 9 and 10 and/or support columns 3. Motor-pump assembly 1 is connected with housing legs 2 by means of screws 17.

Between the bottom of motor-pump assembly 1 and the top of fan housing 5, an intermediate space 18 is provided for the passage of air. An optional intermediate space 19, corresponding to the intermediate spaces between the vanes of cooling pipe 8, can be located at the bottom of cooling pipe 8.

According to the conveyance direction of fan wheel 7, air is drawn in through intermediate space 18 to cooling pipe 8, and passes downwardly and outwardly through intermediate space 19, or vice versa between the pipes and through covering 16. According to the motion direction of the pump assembly 1, hydraulic fluid is conveyed into or drawn out from the second connection passage 15. The hydraulic fluid flows either through cooling pipe 8, out of the cooling pipe through first connection passage 13 and then to a use device (not shown), or vice versa.

The helical or spiral cooling pipe 8 can also be arranged above fan 5, 7. Alternatively, the fan 5, 7 can be arranged between two layers of cooling pipe 8.

The cooling device can also be arranged at other suitable points relative to the housing of the motor-pump assembly, especially above motor-pump assembly 1. Columns 3 are then attached to their housings.

All of the columns or support legs 3 can be connected with each other by an annular arrangement of crosspieces 4.

While various embodiments have been chosen to illustrate the invention, it will be understood by those skilled in the art that various changes and modifications can be made therein without deparating form the scope of the invention as defined in the appended claims.

What is claimed:

1. An apparatus for cooling pressure medium, especially hydraulic fluid, comprising:

pump means, powered by a first motor, for conveying pressure medium, said pump means being supported by four columns and including a pump housing;

fan means, powered by a second motor separated from said first motor, for conveying cooling air, said fan means including a fan housing;

a cooling pipe mounted adjacent said fan means and located between said columns;

two crosspieces connecting two pairs of said columns to define two U-shaped supports, said fan housing being attached only to said U-shaped supports such that said fan means is located between said columns and is not fixedly connected directly to said cooling pipe; and a connection member, overlapping and outside of said fan housing, connecting said pump means and said cooling pipe in fluid communication.

2. An apparatus according to claim 1 wherein said fan means is surrounded by a perforated covering, said perforated covering extending to said pump housing.

3. An apparatus according to claim 2 wherein said perforated covering is fastened to at least one of said connection member and said columns.

4. An apparatus according to claim 1 wherein said connection member is not fixedly connected directly to said fan housing.

5. An apparatus according to claim 1 wherein said cooling pipe extends along a spiral path.

* * * * *